United States Patent [19]

Liebermann

[11] 4,262,734

[45] Apr. 21, 1981

[54] APPARATUS FOR MELT PUDDLE CONTROL AND QUENCH RATE IMPROVEMENT IN MELT-SPINNING OF METALLIC RIBBONS

[75] Inventor: Howard H. Liebermann, Gloversville, N.Y.

[73] Assignee: General Electric Company, Schenectady, N.Y.

[21] Appl. No.: 76,363

[22] Filed: Sep. 17, 1979

[51] Int. Cl.[3] ..... B22D 11/06

[52] U.S. Cl. ..... 164/423; 164/427; 164/429

[58] Field of Search ..... 164/87, 423, 427, 429; 264/176 F, 165

[56] References Cited

U.S. PATENT DOCUMENTS

| | | | |
|---|---|---|---|
| 4,144,926 | 3/1979 | Liebermann | 164/87 |
| 4,177,856 | 12/1979 | Liebermann | 164/87 |

*Primary Examiner*—Robert D. Baldwin
*Assistant Examiner*—K. Y. Lin
*Attorney, Agent, or Firm*—Stephen S. Strunck; James C. Davis, Jr.; Leo I. MaLossi

[57] ABSTRACT

A bearing gas sleeve coaxial with the melt ejection crucible is provided in an apparatus for making glassy alloy ribbons to provide a confluent bearing gas flow which minimizes dynamic fluctuations in the molten alloy puddle from which metallic ribbon is formed during chill block melt-spinning. The bearing gas flow causes an improved quench rate and melt puddle stabilization which results in reduced upper ribbon surface texture and improved edge definition.

10 Claims, 6 Drawing Figures

| BEARING GAS PRESSURE psi $N_2$ PRIOR TO VALVE OPENING | EJECTION GAS PRESSURE psi He | $Fe_{40}Ni_{40}B_{20}$ SAMPLE |
|---|---|---|
| 0 | 50 |  |
| 20 | 50 | |
| 30 | 50 | |
| 50 | 50 | |

APPARATUS FOR MELT PUDDLE CONTROL AND QUENCH RATE IMPROVEMENT IN MELT-SPINNING OF METALLIC RIBBONS

BACKGROUND OF THE INVENTION

1. Field of the Invention

This invention relates to improvements in apparatus for making glassy alloy ribbons which increases the average quench rate as well as improves the upper ribbon surface texture and ribbon edges during melt-spinning of metallic ribbons.

2. Description of the Prior Art

The ambient atmosphere in which chill-block melt-spinning of metallic ribbons is conducted apparently has little, if any, effect on the upper ribbon surface texture and on ribbon edge definition if processing is conducted within the confines dictated by U.S. Pat. No. 4,144,926 (H. H. Liebermann, 1979). However, undesirable molten alloy puddle fluctuations may be caused by corresponding fluctuations in the melt jet prior to impingement on the moving substrate surface and by impact-induced fluctuations caused by various kinds of imperfections in the substrate surface. The upper ribbon surface topography may consequently have a "ripply" texture which is particularly prominent during the fabrication of metallic ribbons greater than ~2 mm wide.

Therefore, it is an object of this invention to provide new and improved apparatus for chill-block melt-spinning metallic ribbons.

Another object of this invention is to provide new and improved apparatus having means for increasing quench rate during chill-block melt-spinning.

Still another object of this invention is to provide new and improved apparatus for making glassy alloy ribbons which includes means for providing a gas stream confluent with and surrounding the molten alloy jet so as to bear down upon the molten alloy puddle near the point of melt jet impingement on the moving substrate in order to improve heat transfer and to eliminate adverse gas boundary layer effects on ribbon geometry.

Other objects of this invention will, in part, be obvious and will, in part, appear hereinafter.

BRIEF DESCRIPTION OF THE INVENTION

In accordance with the teachings of this invention there is provided an improvement in apparatus for making metallic ribbon by chill-block melt-spinning. The improvement comprises a coaxial bearing gas sleeve for supplying a bearing gas flow which is confluent with the molten alloy jet. The gas jet encompasses and is coaxial with the ejected melt stream as it impinges onto the moving substrate surface. The confluent gas bears down on, and surrounds the melt puddle formed by the impinging melt jet as the ribbon is formed therefrom. The confluent gas smooths out dynamic fluctuations which may occur in the molten alloy puddle. Consequently, any periodic perturbation which may occur in the top surface of the ribbon is reduced and/or substantially eliminated and the quench rate improved as a result of the bearing gas acting on the melt puddle. Additionally, the naturally-occurring gas boundary layer on the surface of the moving substrate is disrupted by the bearing gas, thereby helping to improve edge quality of the ribbon.

A bias gas means may be provided for stabilizing the vertical position of the melt of glassy alloy material in the melt ejection crucible.

DESCRIPTION OF THE INVENTION

Figure 1:
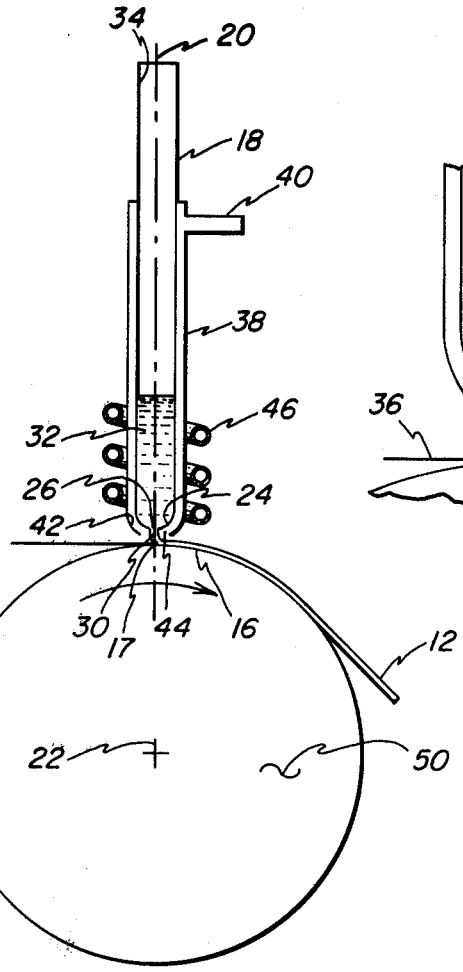
FIG. 1 is a schematic of an apparatus for providing a gas stream confluent with the molten alloy jet in order to minimize dynamic fluctuations in a melt puddle formed to produce metallic ribbons.
Figure 1A:
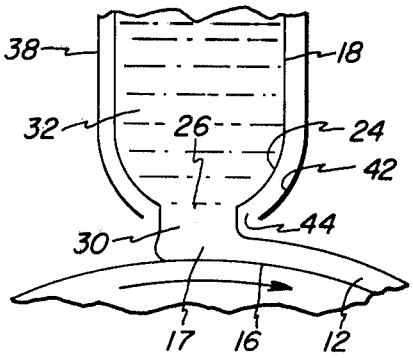
FIG. 1*a* is a schematic enlargement of the melt jet impingement area on the substrate surface.

Referring now to FIG. 1 there is shown apparatus 10 for making metallic ribbon 12. The apparatus 10 comprises a rotating wheel 14 having a circumferential substrate surface 16 upon which alloy jet 30 is caused to impinge. A melt ejection crucible 18 is supported above the substrate surface 16 of the wheel 14 and has a longitudinal axis typically disposed normal to the axis 22 about which the wheel 14 rotates. Immediately above the surface 16, walls 24 define an opening or an orifice 26 in the melt ejection crucible through which a melt jet 30 is ejected from a reservoir 32 of molten alloy to be continuously cast into ribbon form. Wall 34 defines suitable means in the melt ejection crucible 18 to provide access for loading alloy to be cast and for a means of providing an inlet for a suitable melt ejection gas. The gas is employed to overcome melt surface tension and to exert a constant pressure atop the melt reservoir 32 in order to cause a flow of melt 32 through the orifice 26, thereby forming a melt jet 30 which is made to impinge upon the surface 16.

Figure 2:
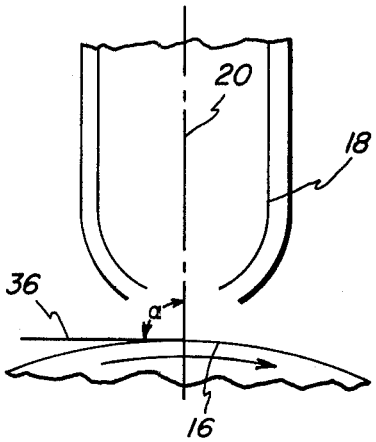
FIG. 2 is a schematic defining the melt jet impingement angle, $\alpha$.

The crucible 18 may be inclined at an angle $\alpha$ with respect to a tangent 36 at the point of melt jet impingement on the substrate surface 16 (FIG. 2). The inclination angle range is $60° \leqq \alpha \leqq 90°$ and preferably $80° \leqq \alpha \leqq 90°$.

A confluent bearing gas sleeve 38 is disposed about at least the lower portion of the crucible 18 which includes the orifice 26. The sleeve 38 is coaxially aligned with the crucible 18 and has an inlet gas port 40. The inlet gas port 40 provides a means for introducing a confluent gas stream about the molten alloy jet and melt puddle from which the ribbon 12 is produced by continuous extraction therefrom. Sleeve walls 42 define an aperture 44 for providing a means for the confluent gas to flow out therefrom and about the melt puddle and ribbon 12.

Heating coil 46 is disposed about the lower portion of both the crucible 18 and the sleeve 38 to provide a means for melting the alloy to be cast and to maintain the melt at a predetermined casting temperature throughout the melt-spinning process. The coil 46 may be of the induction heating type.

In melt-spinning ribbon 12, the substrate wheel 14 is made to rotate at a linear velocity $10\ m/s \leqq V_r \leqq 50\ m/s$ as the coil 46 heats the charged alloy to form the melt 32. When the melt 32 has been formed and stabilized at a predetermined casting temperature, a bearing gas such, for example, as helium, nitrogen, argon, air and the like is caused to flow into the sleeve 38 from inlet port 40, down and around the enclosed portion of the crucible 18 and out through the orifice 44. In order to be effective, the gas flow rate must exceed an empirically determined minimum value which depends on the details of the coaxial nozzle geometry.

When the bearing gas is flowing properly, the melt jet is caused to flow by the application of ejection gas pressure atop the molten alloy reservoir 32. When the ejection gas pressure is established and the melt temperature has been stabilized, the melt 32 is ejected through the orifice 26 to impinge onto the moving substrate surface 16 of the wheel 14. The confluent gas flows down and around the melt puddle and the ribbon 12 formed therefrom. The confluent gas bears down on top of and about the melt puddle 17 thereby stabilizing it as the ribbon 12 is fabricated, improving the overall quench rate and essentially eliminating perturbations in ribbon geometry which might otherwise occur. At the same time, the bearing gas flow acting on the melt puddle 17 disrupts the naturally occurring gas boundary layer on the surface 16 of the rotating substrate wheel 14. As a result, the edges of the ribbon 12 are greatly improved without complying with the teachings of U.S. Pat. No. 4,144,926 (H.H. Liebermann, 1979).

Figure 3:
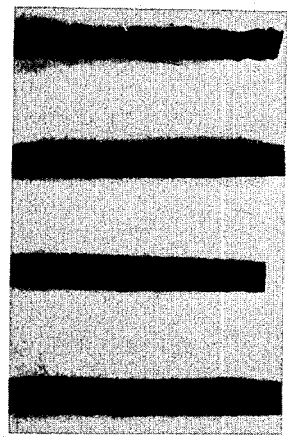
FIG. 3 includes a table demonstrating the effectiveness of the bearing gas flow in the apparatus for melt-spinning metallic ribbons shown in FIG. 1 and also a picture of ribbon material formed under various process conditions.

With reference now to FIG. 3, there are shown photographic reproductions of $Fe_{40}Ni_{40}B_{20}$ glassy alloy ribbons produced at various bearing gas pressures and ejection gas pressures using a particular coaxial nozzle geometry. All the ribbon samples were cast at an angle $\alpha=90°$ on the circumferential surface of a copper substrate wheel having a diameter of 7.5 cm and rotating at 8500 rpm. The substrate surface speed was 33 meters/-second. The orifice of the crucible measured 500 $\mu$m in diameter, the ejection gas was helium, the pressure of which was held constant for all runs at 50 psi (340 kPa) in order to study the effect of the confluent or bearing gas pressure. The bearing gas was nitrogen and the orifice in the nozzle of the bearing gas sleeve 38 measured 7.4 mm in diameter.

The quality of both the surface and the edges improved abruptly as the bearing gas pressure was increased beyond a certain value. A significant improvement in the ribbon quality was noted when the nitrogen gas pressure reached 20 psi for the particular nozzle geometry used.

For best results in minimizing dynamic fluctuations in the melt which must be overcome, the walls 24 of the orifice 26 in the melt ejection crucible 18 should be as smooth as possible and have no sharp edges or corners.

FIG. 3 includes a tabulation of bearing gas pressure prior to opening the bearing gas valve 56 and the corresponding samples of ribbon produced in each instance of the glassy alloy $Fe_{40}Ni_{40}B_{20}$.

Although the apparatus 10 has been shown for melt jet impingement on the circumferential substrate surface 16, the same approach can be employed for making edge-wound ribbon by casting on the flat surface 50 of the wheel 14. The local spatial relations between composite crucible axis 20 and substrate surface 16 would be similar to those discussed before, only now the substrate surface used in continuous casing is the flat wheel surface 50 instead of the circumferential wheel surface 16.

Care must be exercised to prevent a buildup of high bearing gas pressure just outside the nozzle 26 which may force the melt to move upward in the melt ejection crucible 18. One may substantially eliminate this occurrence by a bias gas means between the bearing gas inlet 40 and the melt ejection crucible 18.

Figure 4:
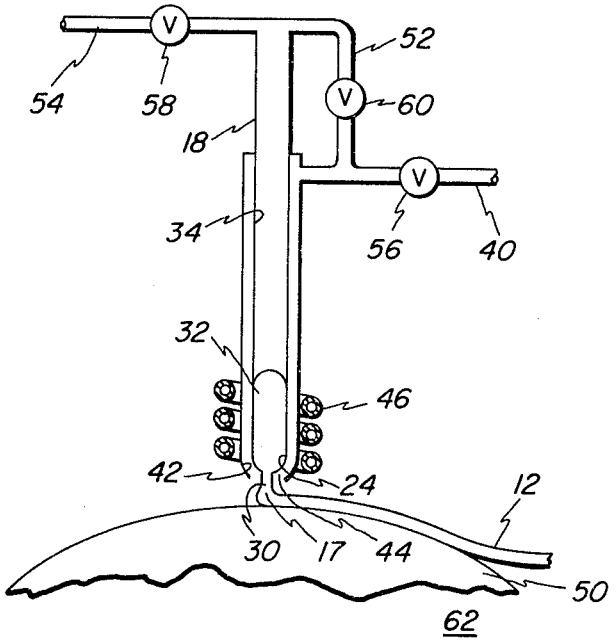
FIG. 4 is a schematic of the apparatus shown in FIG. 1 and modified to include the bias gas circuit.

With reference to FIG. 4 there is shown apparatus 62 which incorporates the bias gas means to prevent the melt from moving upward in the melt ejection crucible 18. All items denoted by the same reference numbers employed in FIG. 1 are the same, and function in the same manner, as described heretofore.

A bleeder line 52 is connected between the bearing gas inlet valve 56 and the melt ejection gas inlet valve 58. Valves 56 and 58 control the flow of gas through the respective lines 40 and 54. A bias gas bleeder valve 60 is installed in the bleeder line 52 to permit adjustment of the gas pressure acting atop the melt 32 to stabilize the melt column vertical position. Operation of the apparatus 62 is as follows:

With valves 56, 58 and 60 closed, the substrate wheel speed, the composite nozzle-substrate spacing, the melt ejection gas pressure, and the bearing gas pressure are set at predetermined values. The alloy to be cast is melted to form reservoir 32. Bearing gas control valve 56 is opened to permit the flow of bearing gas at the predetermined value. Simultaneously, manipulation of the bias pressure valve 60 adjusts the flow of gas bled from the bearing gas to control the melt column vertical position during bearing gas application. The bias gas pressure valve 60 is closed and the melt ejection gas valve 58 opened to activate ejection gas pressure on top of melt 32 to initiate ribbon 12 manufacture.

The amount of bias gas pressure required to achieve melt column vertical position stabilization increases with decreasing nozzle-substrate spacing.

A series of experiments were performed employing apparatus of the configuration of FIG. 4. The orifice inside diameter of the bearing gas sleeve 38 was ~7.4 mm. A 10 inch diameter OFHC copper wheel was used to provide a substrate surface. The circumferential substrate surface employed for casting was finished with 600 grit alumina paper. The substrate surface speed was varied from 6.7 m/s to 53.2 m/s. The melt was $Fe_{40}Ni_{40}B_{20}$ alloy at 1400° K. The minimum spacing between the walls of the melt ejection crucible 18 and the bearing gas sleeve 38 was maintained at ~1 mm. The bearing gas was air and the applied pressure was maintained at 1.8 psi during the run for the particular nozzle geometry used.

The minimum vertical distance between the foot of the ejection crucible 18 and the foot of the bearing gas sleeve 38 was 1 millimeter. It has been discovered that moving the melt ejection crucible 18 up or down by small amounts with respect to the bearing gas sleeve 38 has no significant effect on the resultant performance of the apparatus 10 or 62. The orifice 44-substrate range used was 1 mm$\leqq\delta\leqq$4 mm.

Figure 5:
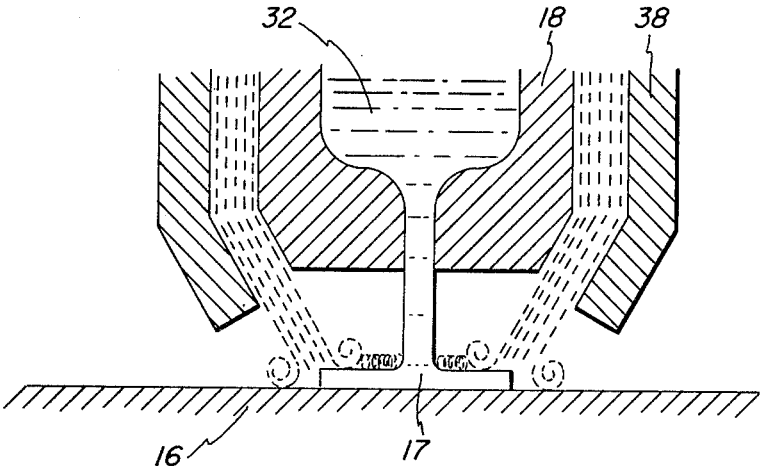
FIG. 5 is a schematic showing preferred conditions for the casting apparatus shown in FIGS. 1, 2, and 4.

Referring now to FIG. 5 there is shown the proper orientation of the bearing gas sleeve nozzle 38 with respect to the ejection crucible 18 in order that the bearing gas flow is properly oriented to reduce the gas boundary layer turbulence along the edges of ribbon as cast and the melt puddle itself. The melt 32 flow must be sufficient so that there is a beneficial intereaction between the cast metal of the puddle 17 and the ribbon and the bearing gas flow. If the melt flow rate is inadequate, the melt puddle is too narrow to have beneficial effects from the bearing gas stream. In such cases, the bearing gas causes severe degradation of the ribbon geometry, particularly the edges. If the melt flow is too great for a particular nozzle geometry, a shoulder buildup of the metal is found on the ribbon edges. The shoulder buildup is apparently the result of the hydraulic jump phenomenon.

Experiments indicate that inclining the coaxial crucible axis 20 at an angle $\alpha < 90°$ with respect to the local tangent to the substrate surface 36 has some effects on ribbon geometry. Preferably $\alpha$ should not be less than 80° . As $\alpha$ decreases from 90°, the ribbon width decreases and the thickness increases.

The use of the bearing gas in the coaxial ejection crucible-bearing gas sleeve nozzle improves the ribbon geometry.

I claim as my invention:

1. An improvement in apparatus for making metallic alloy ribbon comprising a melt ejection crucible including a reservoir for molten alloy meterial to be cast and a nozzle for casting the melt, and first gas inlet means for pressurizing the reservoir to eject said melt onto a moving substrate surface, the improvement comprising a confluent bearing gas sleeve encompassing at least the lower portion of, and coaxially aligned with, said melt ejection crucible, a second gas inlet means for supplying a confluent bearing gas to said confluent bearing gas sleeve, and an outlet orifice in said confluent bearing gas sleeve for directing the flowing bearing gas as a gas stream about a molten alloy stream, the melt puddle formed on said moving substrate surface, and the edge surfaces of the metallic alloy ribbon formed from said puddle.

2. The apparatus of claim 1 wherein said nozzle of said melt ejection crucible is located more distant from said moving substrate surface than said outlet orifice of said confluent bearing gas sleeve.

3. The apparatus of claim 2 wherein the distance from the moving substrate surface to the outlet orifice of said sleeve is designated as $\delta$ and is in the range 1 mm$\leqq\delta\leqq$4 mm.

4. The apparatus of claim 1 and further including bias gas means connected between the first and second gas inlet means for bleeding a portion of said confluent gas to bear on, and stabilize the height of, the reservoir of molten alloy material, first valve means for controlling the flow of gas in said first inlet gas means, second valve means for controlling the flow of gas in said second inlet gas means, and third valve means for controlling the flow of gas in said bias gas means.

5. The apparatus of claim 4 wherein said nozzle of said melt ejection crucible is located more distant from said moving substrate surface than said outlet orifice of said confluent bearing gas sleeve.

6. The apparatus of claim 5 wherein the distance from the moving substrate surface to the outlet orifice of said sleeve is designated as $\delta$ and is in the range 1 mm$\leqq\delta\leqq$4 mm.

7. The apparatus of claim 1 wherein said moving substrate surface is located on the circumferential edge area interconnecting opposed major surfaces of a wheel, said wheel being mounted for rotation about a horizontal axis.

8. The apparatus of claim 1 wherein said moving substrate surface is the top surface of a wheel, said wheel having opposed top and bottom major surfaces and a circumferential edge area interconnecting said major surfaces, said wheel being mounted for rotation about a substantially vertical axis.

9. The apparatus of claim 4 wherein said moving substrate surface is located on the circumferential edge area interconnecting opposed major surfaces of a wheel, said wheel being mounted for rotation about a horizontal axis.

10. The apparatus of claim 4 wherein said moving substrate surface is the top surface of a wheel, said wheel having opposed top and bottom major surfaces and a circumferential edge area interconnecting said major surfaces, said wheel being mounted for rotation about a substantially vertical axis.

* * * * *